United States Patent [19]

Duhn et al.

[11] Patent Number: 4,974,676

[45] Date of Patent: Dec. 4, 1990

[54] GROUND SUBSIDING WELLHEAD

[75] Inventors: Rex E. Duhn; Jay C. Duhn; William D. Chapman, all of Bakersfield, Calif.

[73] Assignee: Duhn Oil Tool, Inc., (dba Wellhead, Inc.), Bakersfield, Calif.

[21] Appl. No.: 364,804

[22] Filed: Jun. 9, 1989

[51] Int. Cl.[5] ..... E21B 33/047

[52] U.S. Cl. ..... 166/88; 166/67; 166/89

[58] Field of Search ..... 166/88, 89, 75.1, 67, 166/85, 379; 285/144–148

[56] References Cited

U.S. PATENT DOCUMENTS

| | | | |
|---|---|---|---|
| 3,011,552 | 12/1961 | Rhodes et al. | 166/67 |
| 3,134,610 | 5/1964 | Musolf | 166/68 X |
| 3,166,125 | 1/1965 | Hubby | 166/67 |
| 3,192,592 | 7/1965 | Yancey | 285/144 X |
| 3,316,963 | 5/1967 | Boldrick et al. | 166/379 X |
| 3,738,426 | 6/1973 | Drouin | 166/89 X |
| 3,741,297 | 6/1973 | Drouin | 166/89 |

OTHER PUBLICATIONS

Burley et al., "A Solution to Ground Subsidence Problems in Casing Strings and Wellheads", The Journal of Petroleum Technology, pp. 654–660, June 1971.

*Primary Examiner*—Hoang C. Dang

*Attorney, Agent, or Firm*—Christie, Parker & Hale

[57] ABSTRACT

A ground subsidence wellhead has a lower wellhead assembly mounted on the ground for supporting a casing in tension and an upper wellhead assembly threaded to the top of the casing and spaced from the lower wellhead assembly. The lower assembly has a casing head with aconical bowl for receiving a slip. The slip is wedged between the casing head and casing by compression springs acting between the casing head and the slip, and has asymmetrical teeth for engaging the casing to prevent downward, but allow upward, movement of the casing in the slip.

19 Claims, 3 Drawing Sheets

GROUND SUBSIDING WELLHEAD

BACKGROUND OF THE INVENTION

This invention relates to a ground subsiding wellhead. More particularly, the invention relates to a wellhead for use in a system for reestablishing tension in the casing on which the wellhead is mounted when tension has been lost due to ground subsidence.

A wellhead supports a production string. The string includes a production casing, through which petroleum reacnes the surface. The casing is in tension to avoid its buckling under its own weight. Tension is maintained by a lower wellhead assembly at the surface of the ground. The bottom of the casing is generally fixed to the bottom of the well by cementing or the like. The extraction of petroleum from the well reduces ground support, and the ground subsides. The lower wellhead subsides too, reducing the tensile stress in the production string, even reversing it to compression. This is described in an article in the *Journal of Petroleum Technology* ("A Solution to Ground Subsidence Problems in Casing Strings and Wellheads," Burley, J.D. et al., pp. 654–660, June 1971).

One solution to the subsidence problem is to excavate below the wellhead and raise the entire wellhead by hydraulic jacks to retension the casing. This solution is undesirable in that it requires excavating a hole and disconnecting cellar and flow lines, among other reasons.

To improve upon this method, the article suggests a wellhead of a separate lower casing head and an upper tubing head, and retensioning the casing as needed by hydraulically jacking the upper tubing head with respect to the lower casing head. In particular, a standard tubing head is modified by threading it onto the top of the casing and leaving a space between the tubing head and a packoff flange of the casing head. The casing head mounts the pack off flange above a hanger packoff. A casing hanger has a slip of segments that have conical outer surfaces and teeth on their inside to engage the casing. The conical outer surfaces of the slip segments engage a complementary conical surface of a bowl of the casing hanger. The casing hanger has a plate bolted to the top of the bowl. Springs between this plate and the slip segments force the slip segments downward into engagement with the casing. The entire casing hanger is supported by the casing head but lifts off the support to close a space between the hanger and structure of the casing head that does not move, specifically a seal assembly, when retensioning the casing.

U.S. Pat. Nos. 3,738,426 and 3,741,297 disclose a similar wellhead and retensioning method.

The described wellheads lift the casing hanger off the casing head during retensioning. When the hydraulic jacks release the casing hanger, it moves down to seat on the casing head. This movement of the casing hanger relieves some of the tension, making retensioning inexact.

SUMMARY OF THE INVENTION

The present invention provides a wellhead that enables retensioning of a casing simply, quickly, and accurately.

The invention retensions a casing by a jacking system while a slip of the lower wellhead assembly stays seated in a casing head bowl. A bias between the slip and the lower wellhead assembly effectively keeps the slip seated, permitting the slip to raise only enough to disengage the casing during retensioning so that after retensioning the slip moves only slightly to engage the casing and pickup its stress and maintain the tension.

In one form, the invention provides a wellhead formed by upper and lower wellhead assemblies. The lower wellhead assembly includes a casing head that is fixed in position with respect to the ground and supports the tension of underground casing. The upper wellhead assembly attaches to the top of the casing. The top of the lower wellhead assembly and the upper wellhead assembly can receive hydraulic jacks to retension the casing when the ground subsides and the casing loses tension. The slip is spring biased downward from a fixed portion of the casing head into engagement with the conical seat of a bowl. This bias maintains substantially continuous engagement between the slip and the casing head during retensioning because it needs to lift only slightly during retensioning.

In greater detail, a packoff of the lower wellhead assembly is inside of the casing head. The packoff has a bottom spring retention plate in contact with the top of the slip that keep a plurality of springs properly positioned so that they cannot move radially. The packoff also has an upper spring retainer plate spaced from the lower one that also maintains the correct radial position of the springs. The space between the retention plates permit the slips to move vertically to accommodate casings of different outside diameters resulting from tolerances of the casings, to release the casing during retensioning, and to engage the casing to maintain tension. The slip has asymmetrically shaped teeth so that the casing can move upward with respect to the slip but not downward.

In addition, the tubing head has an upper external flange that permits the jacks to engage an underside of the flange well above the lower end of the tubing head so the tubing head need not extend as far from the ground as would be necessary where the tubing head is jacked from its lowermost end. In other words, the tubing head can be located closer to the lower casing head while still permitting jacking.

These and other features, aspects and advantages of the present invention will become more apparent from the detailed description, drawings and appended claims.

DETAILED DESCRIPTION OF THE PREFERRED EMBODIMENTS

The invention maintains tension in the casing of a wellhead and permits easy and accurate retensioning.

Figure 1:
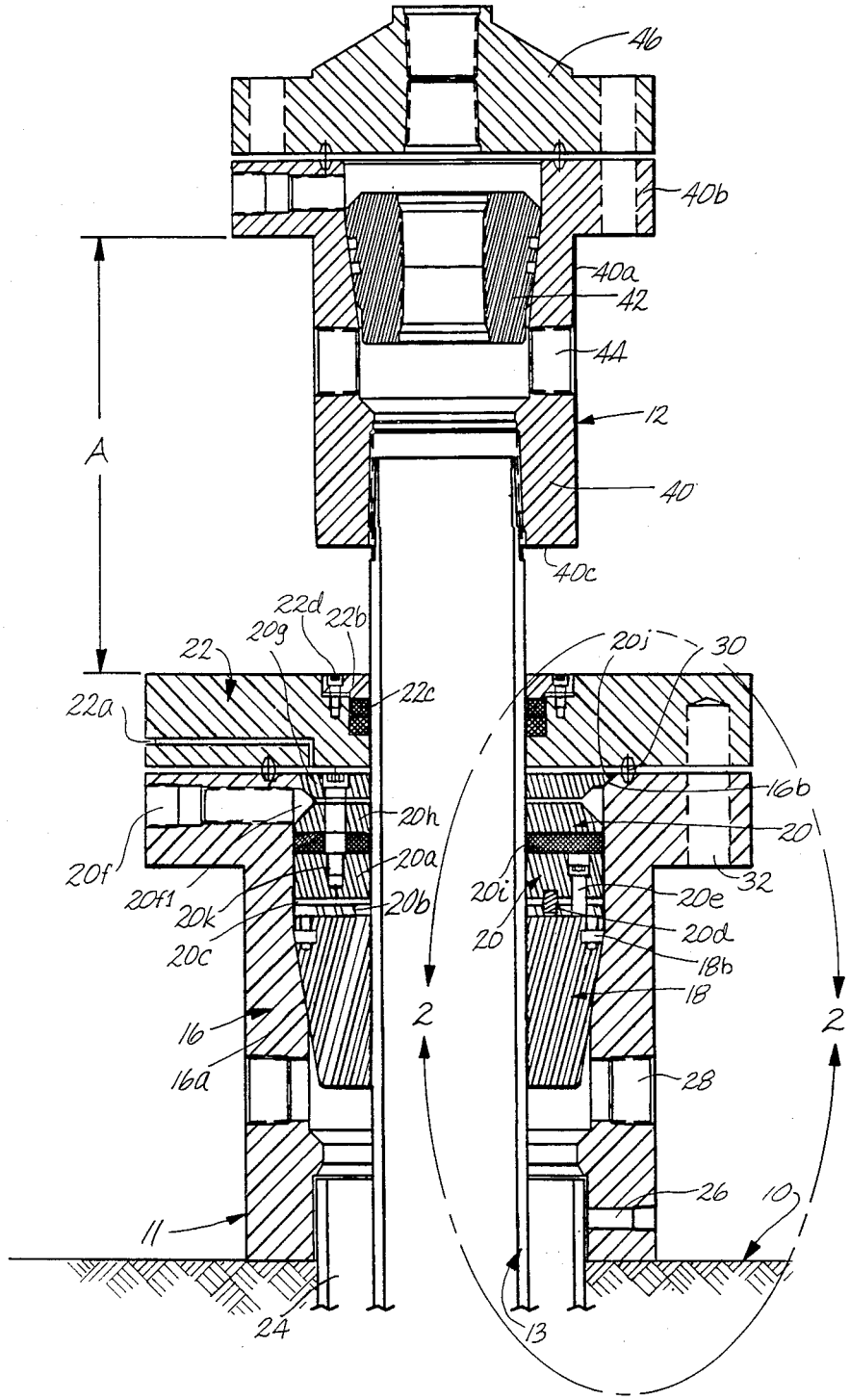
FIG. 1 is an elevational, cross-sectional view of the preferred form of the wellhead of the invention and an upper of a casing that is held in tension by the wellhead.
Figure 2:
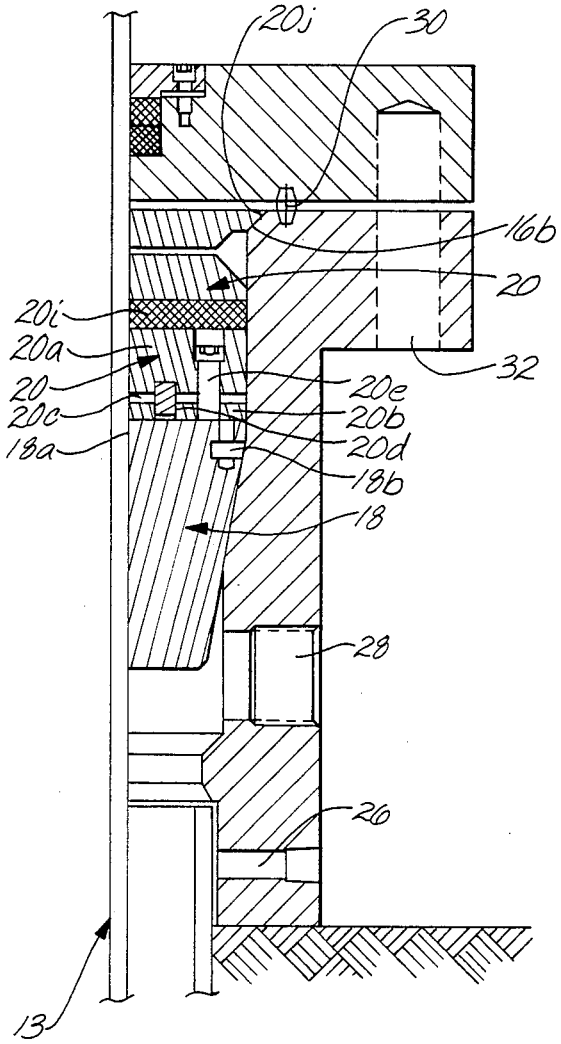
FIG. 2 is an enlarged view of the area bounded by the arrows in FIG. 1.
Figure 3:
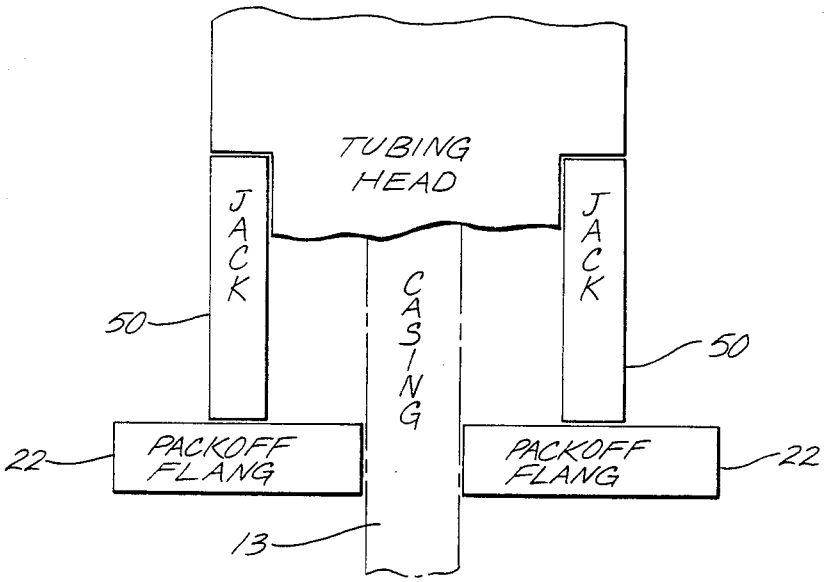
FIG. 3 is a cross-sectional, partial schematic view of the wellhead during retensioning.

The wellhead of FIGS. 1 and 3 has a lower wellhead 11 and an upper wellhead 12, both attached to a casing 13.

Lower wellhead 11 rests on ground 10. One of the functions of the lower wellhead is to support casing 13 in tension. Lower wellhead 11 includes a casing head 16, a slip 18, a packing assembly 20 (packoff), and a packoff flange 22.

Casing head 16 has a bowl 16*a* for seating slip 18. Slip 18 has teeth 18*a* for engaging the exterior of the casing 13 and applying tension to it. Teeth 18*a* are asymmetrically shaped to allow the casing to move upward relative to the slip, but impede or prevent downward movement. In the preferred embodiment, slip 18 is formed by four slip segments joined by hinges 18*b*. Each slip segment includes teeth 18*a*.

Slip 18 permits the wellhead to serve casings of varying diameters. Bowl 16*a* and the slip have complementary conical surfaces that permit movement of the slip vertically and radially with respect to the casing head while maintaining engagement of the bowl by the slip at all times. The slip, in other words, moves in the bowl until reaching the position required by the particular diameter of the casing. For a casing of oversized tolerance, the slip will seat higher than with a casing of smaller diameter. To accommodate the different possible slip positions, there is a space 20*c* between slip 18 and packoff 20.

Packoff 20 in its seated position, is located on top of slip 18 inside of casing head 16. Upper and lower spring retention plates 20*a* and 20*b*, respectively, have space 20*c* between them. These plates position a plurality of coil springs 20*d* for biasing slip 18 against its seat in the bowl. Since plates 20*a* and 20*b* seat springs 20*d* in holes in the plates, the springs will not move radially even if the slip moves radially. Retention plates 20*a* and 20*b* are coupled by shoulder bolts 20*e*. The shoulders of the shoulder bolts engage the upper surface of retainer plate 20*b*. The heads of the shoulder bolts engage the bottom of the holes in retainer plate 20*a*. These engagements define the maximum width of space 20*c*. When the slip seats higher in the bowl than shown in the figures, space 20*c* narrows and the heads of shoulder bolts 20*e* lift off the bottoms of their receiving holes.

One purpose of packoff 20 is to react the bias force of springs 20*d*. Packoff 20 also includes upper and lower annular plates 20*g*, 20*h*, respectively. These plates do not move in service with respect to the ground and bowl 16*a*. These plates also determine the position of plate 20*a*. Accordingly, the ends of springs 20*d* that engage plate 20*a* do not move when the slip moves; the springs only shorten or elongate. The slip and retention plate 20*b* can move with respect to packoff 20, varying the width of space 20*c*. Springs 20*d* wedge slip 18 tightly against the casing.

Screws 20*f*, say, six in number, engage lower plate 20*h* through tips 20fl of the screws. Lower plate 20*h* sits on an annular, resilient seal 20*i*. Seal 20*i* seals against the outside of casing 13. Screws 20*f* engagement of plate 20*h* adjust the compression on the seal.

Upper plate 20*g* rests on casing head 16 at mating slanted surfaces 20*j* and 16*b*. Upper plate 20*g* is bolted to upper spring retention plate 20*a* by shoulder bolts 20*k*, which pass through lower plate 20*h* and seal 20*i*. The shoulder bolts have a shoulder that bears against the upper surface of plate 20*a* to establish the vertical position of this plate. Plate 20*a* then hangs from plate 20*g* through bolts 20*k* and its vertical position is determined by the vertical position of plate 20*g*, which is fixed relative to the ground and bowl 16*a*.

Below lower wellhead 11, casing 13 is received in a conduction pipe 24. This pipe communicates with a source of fluid or fluids through a passage 26 and/or passage 28, as is well-known in the art.

Packoff flange 22 is supported on casing head 16 by means of a sealing member 30, such as a metal ring, and is fixed to the casing head by bolts in threaded holes 32. An upper portion of flange 22 adjacent casing 13 mounts an annular plate 22*b* that bears on a resilient packing member 22*c* that seals against casing 13. Annular plate 22*b* connects to flange 22 by bolts 22*d*. Bolts 22*d* adjust the compression on seal 22*c*.

Flange 22 has a passageway 22*a* for testing the seal of metal seal 30, seal 22*c* and 20*i*.

Upper wellhead 12 includes a tubing head 40 and is threaded onto the top of casing 13. Tubing head 40, as is standard, is T-shaped with a lower portion 40*a* of one diameter and an upper flange 40*b* of a greater diameter than the lower portion. Upper flange 40*b* is for receiving hydraulic jacks, and is a distance A from the top surface of packoff flange 22, say 25 inches. This T-shape enables the hydraulic jacks to easily fit between flange portion 40*b* and packoff flange 22, without extending casing 13 to a height necessary to jack under lower portion 40*a*.

The tubing head is conventional, and includes a tubing hanger 42, a threaded passage 44 for a line pipe, and an adapter flange 46.

To assemble the wellhead, casing 13 and conduction pipe 24 are fitted in the well in a conventional way. The casing may exceed 1,000 feet and may be cemented throughout its entire length while the casing is in tension. A production string of, say, 6,000 feet of tubing is mounted in tension with the bottom 1,000 feet cemented.

Slip 18 and packoff 20 seat in casing head 16 with teeth 18*a* of the slip engaging the casing to maintain tension.

The upper wellhead assembly threads onto casing 13 at tubing head 40.

As seen in FIG. 3, when it is time to retension casing 13, the casing is pulled upward by raising the upper wellhead assembly 12 with respect to lower wellhead assembly 11 through jack 50. The retensioning operation is performed by placing the jacks between the top surface of the packoff flange 22 and the lower surface of upper flange 40*b*. The upper wellhead assembly 12, and thus casing 13, is jacked up with respect to lower wellhead assembly 11 and the ground. The desired amount of retensioning may be taken as the original amount of tension in which the casing 13 was landed.

As noted, during jacking casing 13 is pulled upward with respect to lower wellhead assembly as noted above. As casing 13 moves upward, the engagement of slip 18 and casing 13 tends to carry the slip upward. However, slip 18 remains seated because springs 20*d* act, in effect, between the ground and the slip. There will be upward movement of slip 18 as the strain on it is relieved by the jacks taking up the tension, but the slip will remain engaged with bowl 16*a*. When the jacks release the tubing head, the slip because of the springs 20*d* and teeth 18*a* will maintain the tension essentially the same. This results because the slip does not move except in strain from the tension it now maintains and from the slight movement resulting from its wedging tightly into the bowl. Stated in other words, the packoff is fixed with respect to the casing head. The slip engages the packoff through the springs. Accordingly, during retensioning, the slip and bowl do not move up as in the approach taken in the article and the patents discussed in the Background section of this specification. Because no such movement occurs, the loss of tension resulting from the required movement of the slip to seat in the bowl on the casing head of this earlier approach does not occur.

The above embodiment of the invention is the preferred embodiment but it is not necessarily intended to limit the scope of the appended claims.

What is claimed is:

1. A casing retensioning ground subsidence wellhead that mounts on a casing protruding from the ground and supports the casing in tension, the wellhead comprising an upper wellhead assembly and a lower wellhead assembly, the upper wellhead assembly being adapted to mount on the casing above the lower wellhead assembly, the lower wellhead assembly being adapted to mount around the casing and be supported by the ground in a fixed position relative to the ground, the lower wellhead assembly comprising:

(a) a radially expandable annular slip for engaging the casing and maintaining it under tension, the slip permitting upward movement of the casing with respect to the slip during retensioning of the casing and having a conical outer surface;

(b) an annular bowl having a conical inner surface complementing the conical outer surface of the slip, the slip being seated in the bowl with the conical surfaces in engagement;

(c) a casing head supported by the ground for vertically supporting the bowl, the bowl being fixed in position with respect to the casing head; and (d) means in the casing head for restricting upward movement of the slip relative to the bowl during casing retensioning, such means including biasing means in series force relationship between the casing head and the ground and the slip that bias the slip to seat in the bowl, the biasing means reacting substantially all of any upward force applied to the slip by the casing during retensioning and in turn being reacted directly by the wellhead such that upward movement of the slip relative to ground is opposed by the biasing means.

2. A wellhead according to claim wherein the slip has asymmetrically shaped teeth for engaging the outer surface of the casing, the teeth permitting upward movement of the casing relative to the slip and preventing downward movement of the casing relative to the slip.

3. A wellhead according to claim 1 wherein the upper wellhead assembly is spaced from the lower wellhead assembly.

4. A wellhead according to claim 3 wherein the upper wellhead assembly has a lower substantially cylindrical portion of a first diameter and an upper flange of a second diameter greater than the first diameter.

5. A wellhead according to claim 1 wherein the lower well head assembly includes a packoff suspended from the casing head and attached to it, the biasing means acting between the packoff and the slip.

6. A wellhead according to claim 5 wherein there is a space between the packoff and the slip to accommodate vertical movement of the slip necessitated by different diameter casings and slight upward movement of the slip during retensioning.

7. A wellhead according to claim 6 wherein the biasing means includes a plurality of circumferential disposed compression springs acting between the packoff and the slip.

8. A wellhead according to claim 7 including spring retainer plates bounding the accommodation space, the retainer plates including means for preventing the springs from moving radially.

9. A wellhead according to claim 7 wherein the packoff includes an upper plate suspended from the casing head and providing the suspension of the packoff, a lower plate below and adjacent to the upper plate, a seal below and bearing against the lower plate, the seal being adapted to seal against the casing and an interior wall of the casing head, and an upper spring retainer plate below and bearing against the seal, the upper spring retainer plate bounding the accommodation space, restraining the springs from radial movement and reacting the compression of the springs, the upper spring retainer plate having a fixed position relative to the casing head.

10. A wellhead according to claim 9 including attachment means attaching the upper spring retainer plate directly to the upper plate, the attachment means locating the upper plate with respect to the casing head.

11. A wellhead according to claim 10 wherein the attachment means includes a plurality of shoulder bolts, each having a shoulder engaging the upper spring retainer plate.

12. A wellhead according to claim 11 including a plurality of radially disposed threaded pins in threaded engagement with the casing head, each pin having a tip in engagement with an associated inclined surface of the lower plate to axially load such plate, compress the seal and load the shoulder bolts in tension.

13. A wellhead according to claim 12 including a lower spring retainer plate bearing on the slip and having means to prevent radial displacement of the springs.

14. A subsidence wellhead comprising:

(a) a tubing head assembly adapted to be attached to the upper end of a string of casing;

(b) a casing head for disposition below the tubing head and adapted to be supported by the ground and to receive the string of casing, the casing head and the tubing head having opposed surfaces for jacking the tubing head away from the casing head to tension the casing string, the casing head having a conically surface bowl fixed in positional relationship with respect to ground with the surface diverging toward the tubing head;

(c) a slip defined by a plurality of segments, each having an external conical surface mating with the conical surface of the bowl and an inner surface having teeth for engaging the casing string;

(d) a packoff attached in fixed positional relationship to the casing head above the slip and being normally spaced from the slip by an accommodation space; and (e) a plurality of compression springs acting between the packoff and the slip and in series force relationship between the packoff, casing head and ground.

15. A wellhead according to claim 14 wherein the packoff includes a pair of vertically spaced apart annular packoff plates and a seal, the packoff plates sandwiching the seal, the lower of the annular plates providing the upper boundary for the accommodation space and a bearing support for the compression springs so that the compression force of the springs is reacted by the lower plate.

16. A wellhead according to claim 15 including a lower spring retention plate having means to maintain the radial position of the compression springs constant regardless of the position of the slip.

17. A wellhead according to claim 16 wherein the casing head includes an upper plate bearing on the casing head to transmit vertical loads acting downward through the plate to the casing head, the upper plate being adjacent to the upper packoff plate and attaching the packoff to the casing head.

18. A wellhead according to claim 17 wherein the packoff is attached to the upper plate by shoulder bolts secured to the lower of the annular packoff plates with the shoulders of the bolts bearing on the upper surface of such plate and including means to apply a vertical force to the upper of the annular plates to compress the seal between that plate and the lower of the annular packoff plates while tensioning the shoulder bolts.

19. A wellhead according to claim 18 wherein the vertical force application means includes a plurality of pins mounted through threads to the casing head radially about the upper packoff plate and cooperating surfaces of the upper packoff plate and the pins to produce a vertical force onto the upper packoff plate that increases as the pins are threaded radially inward.

* * * * *